US006732751B2

(12) United States Patent
Chiang

(10) Patent No.: US 6,732,751 B2
(45) Date of Patent: May 11, 2004

(54) AUTOMATIC CLEANING APPARATUS FOR PAINT SPRAYER GUN

(75) Inventor: Yi-Hsin Chiang, Taipei Hsien (TW)

(73) Assignee: Chia Chung Enterprise Co., Ltd., Taipei Hsien (TW)

( * ) Notice: Subject to any disclaimer, the term of this patent is extended or adjusted under 35 U.S.C. 154(b) by 179 days.

(21) Appl. No.: 10/023,983

(22) Filed: Dec. 21, 2001

(65) Prior Publication Data

US 2002/0170581 A1 Nov. 21, 2002

(30) Foreign Application Priority Data

May 15, 2001 (TW) ..... 90207878 U

(51) Int. Cl.[7] ..... B08B 3/02

(52) U.S. Cl. ..... 134/102.2; 134/103.2; 134/166 R; 134/186; 134/200

(58) Field of Search ..... 134/102.1, 102.2, 134/102.3, 103.2, 166 R, 166 C, 186, 198, 200

(56) References Cited

U.S. PATENT DOCUMENTS 2,682,273 A * 6/1954 Roach
2,726,667 A * 12/1955 Wigmore
2,745,418 A * 5/1956 Balcom et al.
2,786,000 A * 3/1957 Roach
2,948,285 A * 8/1960 Poe et al.
3,601,135 A * 8/1971 Marlow et al.
3,771,539 A * 11/1973 Desantis
4,025,363 A * 5/1977 DeSantis
4,785,836 A * 11/1988 Yamamoto
4,793,369 A * 12/1988 Robb et al.
4,899,769 A * 2/1990 Tsai
5,183,066 A * 2/1993 Hethcoat
5,213,117 A * 5/1993 Yamamoto
5,388,601 A * 2/1995 Mansur
5,937,875 A * 8/1999 Nygren
6,554,009 B1 * 4/2003 Beijbom et al.

* cited by examiner

*Primary Examiner*—Frankie L. Stinson
(74) *Attorney, Agent, or Firm*—Dennison, Schultz, Dougherty & MacDonald

(57) ABSTRACT

Disclosed herein is an automatic cleaning apparatus for paint sprayer gun comprising a solvent cleaning tank, cleaning tank, and a check valve. The solvent cleaning tank has a pressurized air inlet, the cleaning tank has a plurality of vertically erected first tubes equipped with at least one nozzle for each tube, a second tube is connected with each first tube to communicate all first tubes one another, and a third tube is used to communicate the air inlet and the solvent cleaning tank and cause the solvent to be ejected from the nozzles. The check valve is for collecting the solvent in the bottom of the solvent tank. With this structure, the cleaning apparatus of the present invention uses compressed air as its power source so as to eliminate hazardous electrostatic induction owing to mechanical friction caused by rotation of apparatus components during the cleaning operation. The present invention has noticeable advantages of low noise, simple structure, high security, prolonged lifetime, high flexibility and low production cost.

6 Claims, 2 Drawing Sheets

AUTOMATIC CLEANING APPARATUS FOR PAINT SPRAYER GUN

BACKGROUND OF THE INVENTION

1. Field of the Invention

The present invention relates to automatic cleaning apparatus for paint sprayer gun, and more particularly, to an cleaning apparatus for paint sprayer gun which employs compressed air as its power source so as to eliminate hazardous electrostatic induction owing to mechanical friction caused by rotation of apparatus components during the cleaning operation, Accordingly, the cleaning apparatus has noticeable advantages of low noise, simple structure, high security, prolonged lifetime, high flexibility and low production cost.

2. Description of the Prior Art

In a conventional paint sprayer gun, it is normally composed of a gun body, a nozzle, and a paint container, and the nozzle further includes various components such as a nozzle tube, an air inlet collar etc. This causes that the paint sprayer gun must be cleaned after use so as to remove undesired remainder of paint in the component parts of the gun thereby preventing degrading performance of the paint sprayer gun, or mingling the paint color by remaining paint with the new one. Accordingly there has appeared an automatic cleaning apparatus for paint sprayer gun specially for cleaning up each component part of the apparatus.

Incidentally, a conventional cleaning apparatus employs an air compressor associated with a pump as its power source. This causes the conventional cleaning apparatus has to operate with a high cost and high noise. Moreover, the way of motion, such as rotation and reciprocation (pump motion) that the conventional cleaning apparatus relies on is apt to cause explosion of cleaning solvent (such as benzene) contained in the apparatus owing to electrostatic induction induced by mechanical friction thereof.

Aiming at the above depicted defects, the present inventor is to propose a newly developed automatic cleaning apparatus for paint sprayer gun simply constructed with a low production cost, and capable of operating at low noise, high security and prolonged lifetime.

SUMMARY OF THE INVENTION

It is an object of the present invention to provide an automatic cleaning apparatus for paint sprayer gun which comprises a solvent cleaning tank with a compressed air inlet at one side, and a cleaning tank having a plurality of vertical different length first tubes. At least a nozzle is provided at one end of each first tube, and all the other ends of the first tubes are connected together to a second tube. A third tube is connected to the second tube at a proper position thereof. The other end of the third tube is appropriately inserted into the solvent cleaning tank such that the pressurized air is able to enter the solvent cleaning tank thereof from the air inlet and force the solvent to go through the other opening end of the third pipe and is ejected from the individual nozzles. Besides, an entrainer is provided in the cleaning tank, and a plurality of through holes are formed on the board surface of the entrainer and communicating with the nozzles of the first tubes to accept the solvent cleaned out from the component parts of each paint sprayer gun placed in the cleaning tank. Moreover, a check valve is installed at a proper position between the cleaning tank and the solvent cleaning tank for collecting the solvent to flow back to the solvent cleaning tank. In this version, those shortcomings inherent to the conventional techniques described above can be eliminated by the present invention employing compressed air as the power source for cleaning.

It is another object of the present invention to provide an automatic cleaning apparatus for paint sprayer gun, wherein the compressed air inlet has a safety valve and a time counter such that the time counter is able to indicate the safety valve to interrupt the entry of the compressed air from the inlet after air pressure has reached to a prescribed value. Besides, an upper lid is provided for the cleaning tank and a micro switch capable of detecting the air pressure is installed at one corner side of the lid. As soon as the lid is lifted up, the micro switch is actuated to interrupt entry of the compressed air from the inlet so that the nozzles can not eject the solvent thereby protecting the operator securely from being hurt by ejected solvent.

For fuller understanding of the nature and objects of the invention, reference should be made to the following detailed description taken in conjunction with the accompanying drawings.

DETAILED DESCRIPTION OF THE PREFERRED EMBODIMENT

Figure 1:
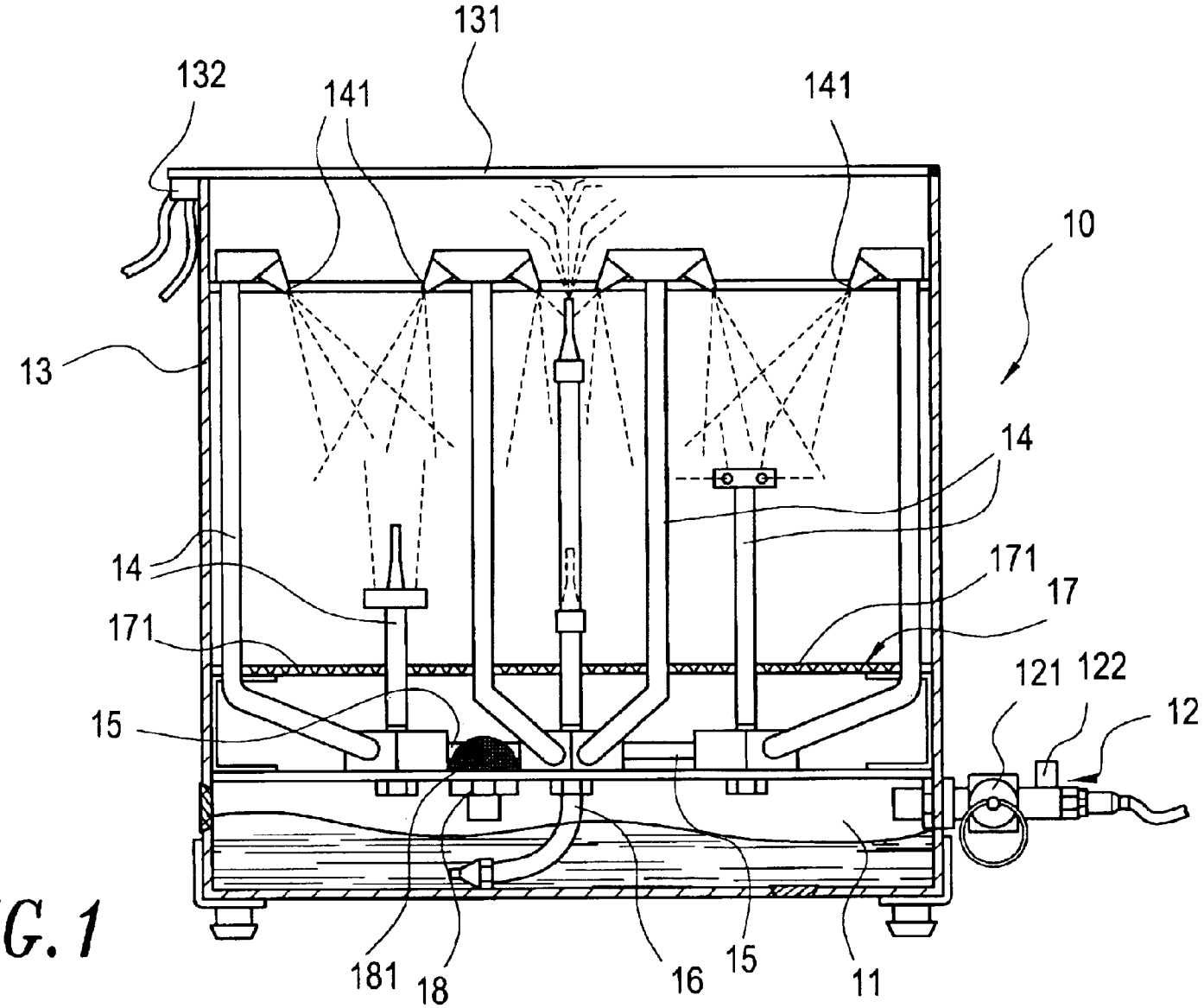
FIG. 1 is a cross sectional view of the present invention.
Figure 2:
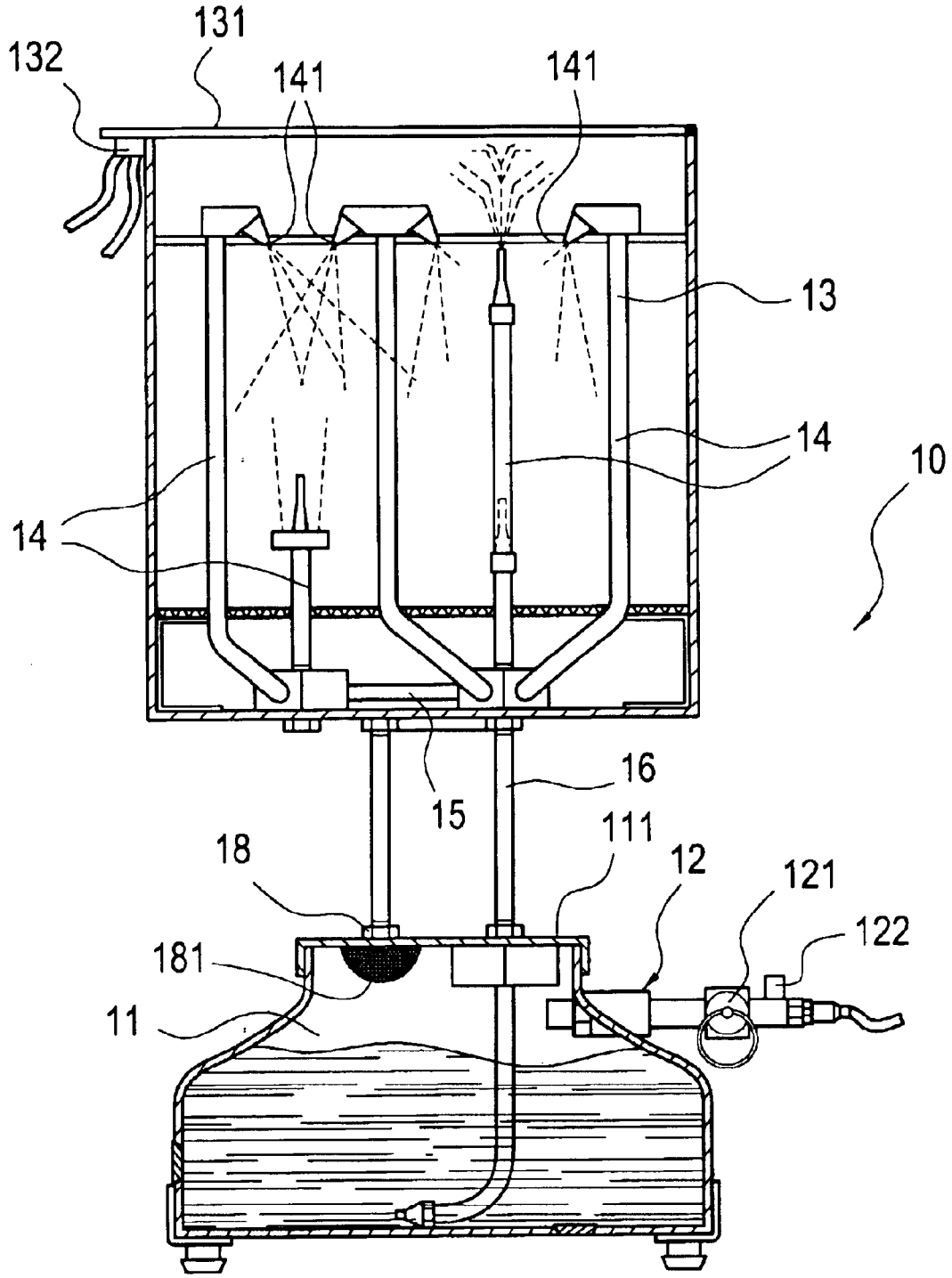
FIG. 2 is a cross sectional view in another embodiment of the present invention.

Referring to FIGS. 1 and 2, the automatic cleaning apparatus for paint sprayer gun of the present invention comprises a km solvent cleaning tank 11 with a compressed air inlet 12 at one side thereof which is communicated with an air compressor (not shown).

The present invention also comprises a cleaning tank 13 having a plurality of vertically erected first tubes 14 of different lengths. Each first tube 14 is equipped with at least a nozzle 141 at its one end, while the other ends are mutually communicated with one another with a second tube 15. A third tube 16 is connected to the second tube 15 at a proper position thereof. The other end of the third tube 16 is appropriately inserted into the solvent cleaning tank 11 such that the pressurized air is able to enter the solvent cleaning tank 11 from the air inlet 12 and force the solvent to pass through the other opening end of the third tube 16 and is ejected from the individual nozzles 141 as shown in FIG. 1.

Besides, an entrainer 17 is provided in the cleaning tanks 14 at a proper height, with all first tubes 14 penetrating through it, and a plurality of through holes 171 are formed on the board surface of the entrainer 17 and communicating with the nozzles 141 of the first tubes 14 to accept the solvent cleaned out from the component parts (not shown) of each paint sprayer gun placed in the cleaning tank 13. Moreover, a check valve 18 is installed at a proper position between the cleaning tank 13 and solvent cleaning tank 11 for collecting the solvent to flow back to the solvent cleaning tank 11 rubbishes in the solvent is filtered by a filter cloth 181 equipped with the check valve 18.

In the present invention, the wall of the solvent cleaning tank 11 can be combined with that of the cleaning tank 13 (see FIG. 1), or two walls are separated (see FIG. 2, the second embodiment). As shown in FIG. 2, a lid 111 is covered on the solvent cleaning tank 13 to which the other end of the third tube 16 is extended thereto for installing the check valve 18.

In the present invention, a safety valve 121 an air release valve and a time counter 122 are installed at the air inlet 12 such that the time counter 122 is able to indicate the safety valve 121 to interrupt entry of the compressed air after air pressure has reached to a prescribed value, and at the same time releases the remaining air pressure in the solvent tank 11 outside via another passage (not shown) of the safety valve 121 thereby halting the flow of solvent.

In the present invention, an upper lid 131 is provided for the cleaning tank 13 and a micro switch 132 capable of detecting the air pressure is installed at a cornerside on the lower surface of the lid 131 such that the micro switch 132 is actuated to interrupt entry of the compressed air from the air inlet 12 when the lid 131 is lifted up thereby prohibiting the nozzles 141 to eject the solvent and protecting the operator securely not to be hurt by ejected solvent. Meanwhile, the micro switch 132 is actuated to let compressed air going into the apparatus from the air inlet 12 and egress the air in the solvent tank from the air release valve quickly for performing cleaning work when the lid 131 is opened.

As described above, the automatic cleaning apparatus for paint sprayer gun according to the present invention employs compressed air as its power source so that possible hazardous electrostatic induction owing to mechanical friction caused by rotating of apparatus components during the operating can be prevented. Accordingly, this cleaning apparatus has noticeable advantages of low noise, simple structure, high security prolonged lifetime, high flexibility and low production cost.

Those who are skilled in the art will readily perceive how to modify the invention. Therefore, the appended claims are to be construed to cover all equivalent structures which fall within the true scope and spirit of the invention.

What is claimed is:

1. An automatic cleaning apparatus for paint sprayer gun comprising a solvent cleaning tank; a cleaning tank; and a check valve;

said solvent cleaning tank has a pressurized air inlet at its one end with a proper height, said cleaning tank has a plurality of vertically erected first tubes of different length, each said first tube is equipped with at least a nozzle at its one end, while the other ends of said first tubes are mutually communicated with one another with a second tube, a third tube is connected to said second tube at a proper position thereof, the other end of said third tube is appropriately inserted into said solvent cleaning tank such that the pressurized air is able to enter said solvent tank from said air inlet, and force the solvent to pass through the other opening end of said third tube and is ejected from said nozzles; said check valve is installed at a proper position between said cleaning tank and said solvent cleaning tank for collecting the solvent in the bottom of said cleaning tank to flow back to said solvent cleaning tank, wherein said solvent cleaning tank and said cleaning tank each includes two walls that are separated, and a lid is provided for said solvent cleaning tank, for allowing insertion of other end of said third tube and installation of said check valve thereof.

2. The cleaning apparatus of claim 1, wherein the wall of said solvent cleaning tank is combined with that of said cleaning tank.

3. The cleaning apparatus of claim 2, wherein a safety valve, an air release valve and a time counter are installed at said air inlet such that said time counter is able to indicate said safety valve to interrupt entry of the pressurized air via said air inlet as soon as the air pressure at said air inlet has reached to a prescribed value.

4. The cleaning apparatus of claim 3, wherein an upper lid is provided for said cleaning tank, and a micro switch capable of detecting the air pressure is installed at a corner on the lower surface of said lid such that said micro switch is actuated to interrupt entry of the compressed air from said air inlet when said lid is lifted up thereby prohibiting said nozzles to eject the solvent and ensuring security, on the other hand, the compressed air is able to enter the apparatus from said air inlet to perform clearing work by actuation of said micro switch when said lid is closed.

5. The cleaning apparatus of claim 1, wherein an entrainer is provided in said cleaning tank at a proper height with a plurality of through holes formed on a board surface of said entrainer, said first tubes are penetrating through said entrainer together with their nozzles such that the solvent ejected by said nozzles is able to flow into said through holes.

6. The cleaning apparatus of claim 1, wherein a filter cloth is equipped with said check valve.

* * * * *